US007571780B2

(12) United States Patent
Hall et al.

(10) Patent No.: US 7,571,780 B2
(45) Date of Patent: Aug. 11, 2009

(54) JACK ELEMENT FOR A DRILL BIT

(76) Inventors: David R. Hall, 2185 S. Larsen Pkwy., Provo, UT (US) 84606; Francis E. Leany, 2185 S. Larsen Pkwy., Provo, UT (US) 84606; Joe Fox, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 414 days.

(21) Appl. No.: 11/535,036

(22) Filed: Sep. 25, 2006

(65) Prior Publication Data

US 2007/0221406 A1 Sep. 27, 2007

Related U.S. Application Data

(63) Continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837.

(51) Int. Cl.
*E21B 10/26* (2006.01)

(52) U.S. Cl. ..... 175/385; 175/404; 175/426

(58) Field of Classification Search ..... 175/404, 175/405.1, 405.2, 385, 421, 426
See application file for complete search history.

(56) References Cited

U.S. PATENT DOCUMENTS 465,103 A 12/1891 Wegner
616,118 A 12/1898 Kuhne
946,060 A 1/1910 Looker
1,116,154 A 11/1914 Stowers
1,183,630 A 5/1916 Bryson
1,189,560 A 7/1916 Gondos
1,360,908 A 11/1920 Everson
1,387,733 A 8/1921 Midgett
1,460,671 A 7/1923 Hebsacker
1,544,757 A 7/1925 Hufford
1,821,474 A 9/1931 Mercer
1,879,177 A 9/1932 Gault
2,054,255 A 9/1936 Howard
2,064,255 A 12/1936 Garfield
2,169,223 A 8/1939 Christian
2,199,692 A * 5/1940 Catland ..... 175/413
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,578,593 A * 12/1951 Phipps ..... 175/385
2,755,071 A 7/1956 Kammerer
2,776,819 A 1/1957 Brown
2,807,443 A * 9/1957 Wyman ..... 175/404

(Continued)

*Primary Examiner*—Hoang Dang
(74) *Attorney, Agent, or Firm*—Tyson J. Wilde

(57) ABSTRACT

In one aspect of the present invention, a drill bit has an axis of rotation and a working face with a plurality of blades extending outwardly from a bit body. The blades form in part an inverted conical region and a plurality of cutters with a cutting surface are arrayed along the blades. A jack element is coaxial with the axis of rotation and extend within the conical region within a range defined by the cutting surface of at least one cutter.

30 Claims, 12 Drawing Sheets

U.S. PATENT DOCUMENTS 2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,199,617 A * 8/1965 White ..... 175/404
3,294,186 A 12/1966 Buell
3,301,339 A 1/1967 Pennebaker, Jr.
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,186,628 A * 2/1980 Bonnice ..... 76/108.2
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A * 8/1985 Ippolito et al. ..... 175/404
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,858,706 A * 8/1989 Lebourgh ..... 175/431
4,889,017 A 12/1989 Fuller
4,962,822 A 10/1990 Pascale
4,981,184 A 1/1991 Knowlton
4,991,670 A * 2/1991 Fuller et al. ..... 175/428
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
6,929,076 B2 8/2005 Fanuel et al.
6,953,096 B2 10/2005 Glenhill
2003/0213621 A1 11/2003 Britten
2004/0238221 A1 12/2004 Runia
2004/0256155 A1 12/2004 Kriesels

* cited by examiner

JACK ELEMENT FOR A DRILL BIT

CROSS REFERENCE TO RELATED APPLICATION

This patent application is a continuation-in-part of U.S. patent application Ser. No. 11/278,935 filed on Apr. 6, 2006 now U.S. Pat. No. 7,426,968 and which is entitled Drill Bit Assembly with a Probe. U.S. patent application Ser. No. 11/278,935 is a continuation-in-part of U.S. patent application Ser. No. 11/277,394 which filed on Mar. 24, 2006 now U.S. Pat. No. 7,398,837 and entitled Drill Bit Assembly with a Logging Device. U.S. patent application Ser. No. 11/277,394 is a continuation-in-part of U.S. patent application Ser. No. 11/277,380 also filed on Mar. 24, 2006 and entitled A Drill Bit Assembly Adapted to Provide Power Downhole. U.S. patent application Ser. No. 11/277,380 is a continuation-in-part of U.S. patent application Ser. No. 11/306,976 which was filed on Jan. 18, 2006 and entitled "Drill Bit Assembly for Directional Drilling." U.S. patent application Ser. No. 11/306,976 is a continuation-in-part of Ser. No. 11/306,307 filed on Dec. 22, 2005, entitled Drill Bit Assembly with an Indenting Member. U.S. patent application Ser. No. 11/306,307 is a continuation-in-part of U.S. patent application Ser. No. 11/306,022 filed on Dec. 14, 2005, entitled Hydraulic Drill Bit Assembly. U.S. patent application Ser. No. 11/306,022 is a continuation-in-part of U.S. patent application Ser. No. 11/164,391 filed on Nov. 21, 2005, which is entitled Drill Bit Assembly. All of these applications are herein incorporated by reference in their entirety.

BACKGROUND OF THE INVENTION

This invention relates to drill bits, specifically drill bit assemblies for use in oil, gas and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit whirl in hard formations may result in damage to the drill bit and reduce penetration rates. Further, loading too much weight on the drill bit when drilling through a hard formation may exceed the bit's capabilities and also result in damage. Too often unexpected hard formations are encountered suddenly and damage to the drill bit occurs before the weight on the drill bit may be adjusted.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a downhole sensor sub in the lower end of a drillstring, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

In one aspect of the present invention, a drill bit has an axis of rotation and a working face with a plurality of blades extending outwardly from a bit body. The blades form in part an inverted conical region and a plurality of cutters with a cutting surface is arrayed along the blades. A jack element is coaxial with the axis of rotation and extended within the conical region within a range defined by the cutting surface of at least one cutter.

The cutters and a distal end of the jack element may have hard surfaces, preferably over 63 HRc. Materials suitable for either the cutter or the jack element may be selected from the group consisting of diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond cubic boron nitride, chromium, titanium, aluminum, matrix, diamond impregnated matrix, diamond impregnated carbide, a cemented metal carbide, tungsten carbide, niobium, or combinations thereof.

The jack element may have a distal end with a blunt geometry with a generally hemi-spherical shape, a generally flat shape, a generally conical shape, a generally round shape, a generally asymmetric shape, or combinations thereof. The blunt geometry may have a surface area greater than the surface area of the cutting surface. In some embodiments, the blunt geometry's surface is twice as great as the cutting surface.

Depending on the intended application of the bit, various embodiments of the bit may out perform in certain situations. The bit may comprise three to seven blades. Cutters attached to the blades may be disposed at a negative back rake angle of 1 to 40 degrees. Some of the cutters may be positioned at different angles. For example the cutters closer to the jack element may comprises a greater back rake, or vice versa. The diameter of the cutters may range for 5 to 50 mm. Cutters in the conical region may have larger diameters than the cutters attached to the gauge of the bit or vice versa. Cutting surfaces may comprise a generally flat shape, a generally beveled shape, a generally rounded shape, a generally scooped shape, a generally chisel shape or combinations thereof. Depending on the abrasiveness of the formation back-up cutters may also be desired. The bit may comprise various cone and flange angles as well. Cone angles may range from 25 to 155 degrees and flank angles may range from 5 to 85 degrees. The gauge of the bit may be 0.25 to 15 inches. The gauge may also accommodate 3 to 21 cutters.

The jack element may extends to anywhere within the conical region, although preferably 0.100 to 3 inches. The jack element may be attached within a pocket formed in the working face of the bit. It may be attached to the bit with a braze, a compression fit, a threadform, a bond, a weld, or a combination thereof. In some embodiments, the jack element is formed in the working face. In other embodiments, the jack element may be tapered. In other embodiments, a channel may connect the pocket to the bore. Such a channel may allow air or enter or exit the pocket when the jack element is inserted or removed and prevent a suction effect. A portion of the working face may extend adjacent the jack element in such a manner as to support the jack element against radial loads. In some embodiments, the working face has cross sectional thickness of 4 to 12 times the cross sectional thickness of the jack element. The working face may also have 4 to 12 times the cross sectional area as the jack element.

DETAILED DESCRIPTION OF THE INVENTION AND THE PREFERRED EMBODIMENT

Figure 1:
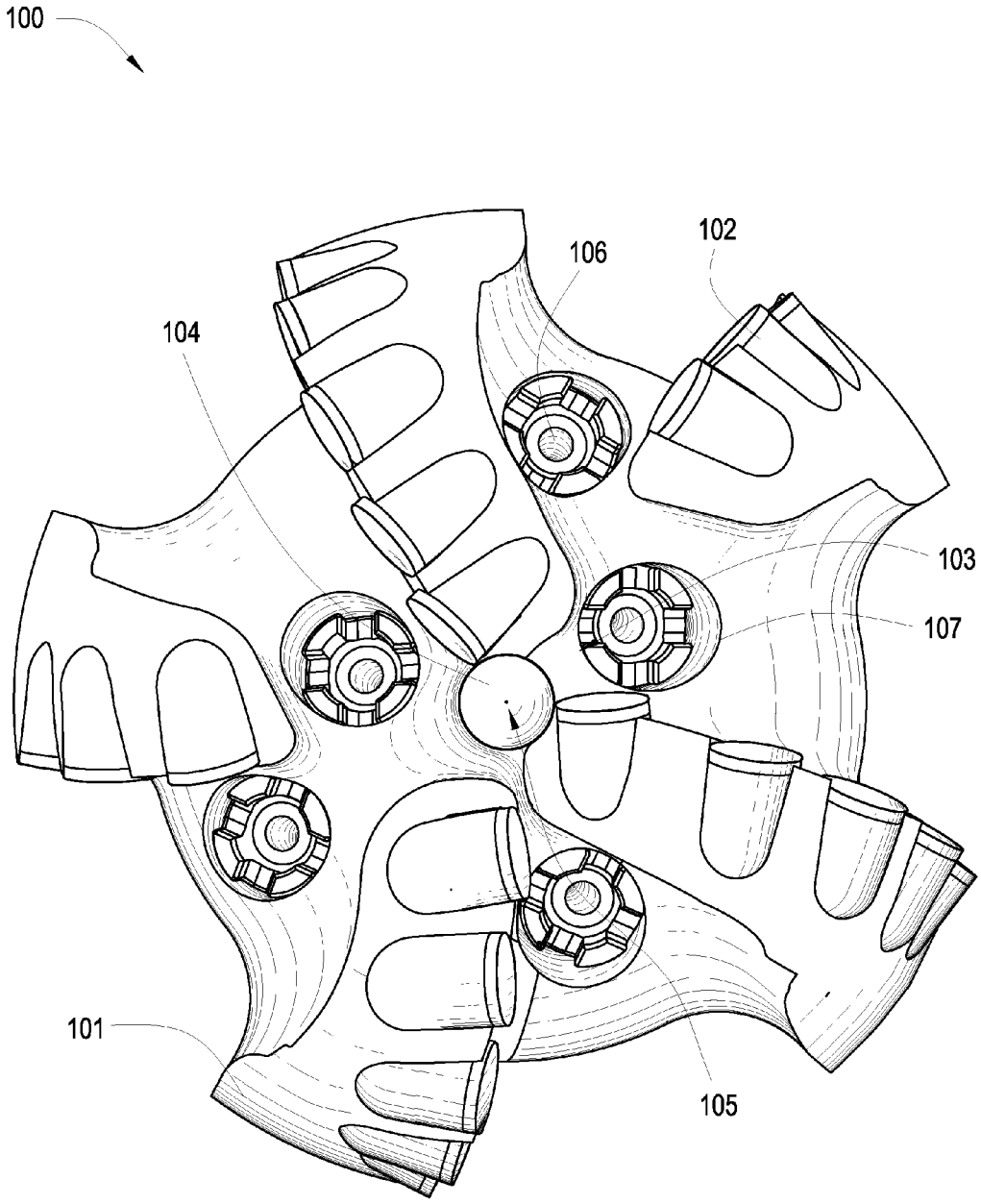
FIG. 1 is a bottom perspective diagram of an embodiment of a drill bit.
Figure 2:
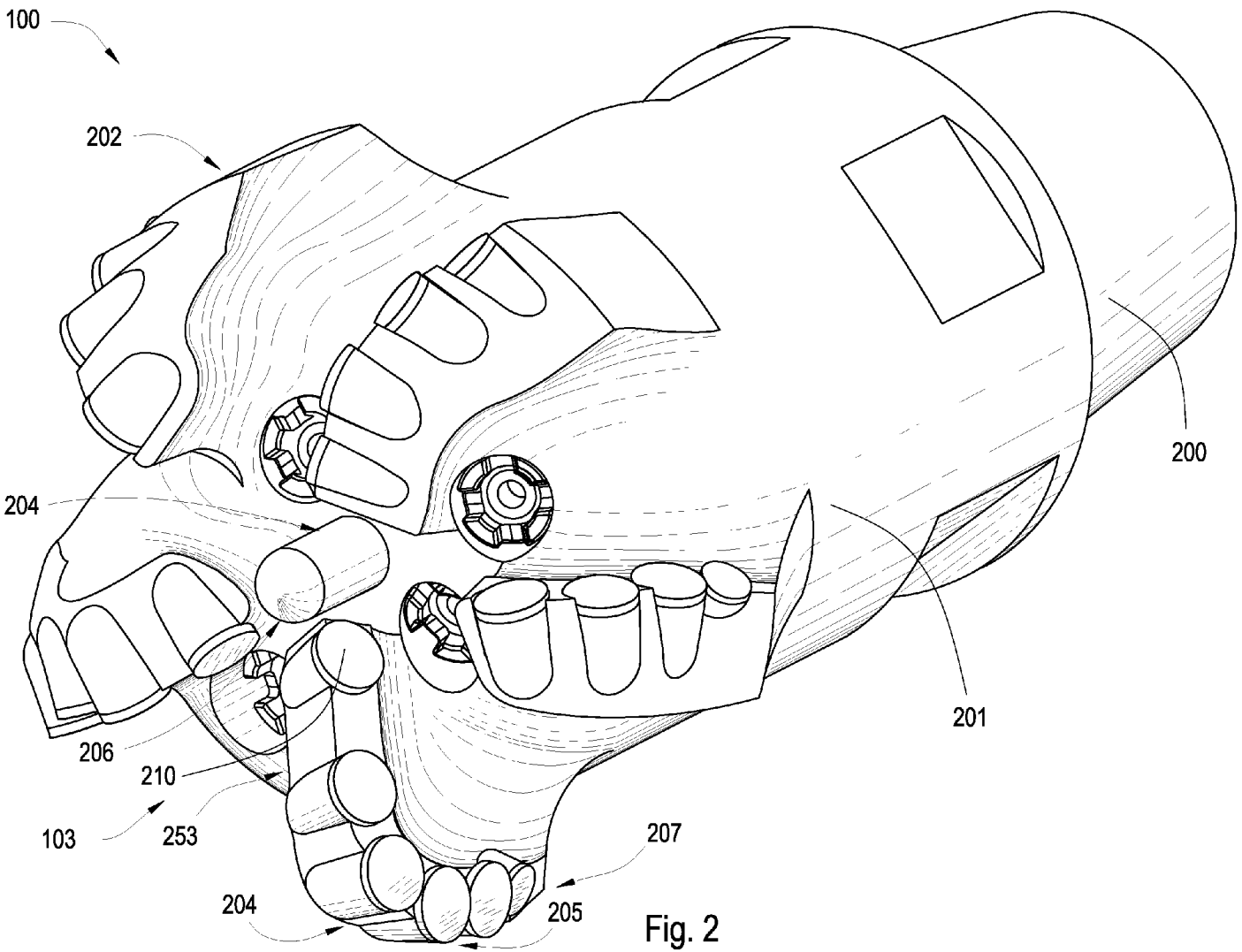
FIG. 2 is a side perspective diagram of an embodiment of a drill bit.

FIGS. 1 and 2 disclose a drill bit 100 of the present invention. The drill bit 100 comprises a shank 200 which is adapted for connection to a downhole tool string such as drill string made of rigid drill pipe, drill collars, heavy weight pipe, reamers, jars, and/or subs. In some embodiments coiled tubing or other types of tool string may be used. The drill bit 100 of the present invention is intended for deep oil and gas drilling, although any type of drilling is anticipated such as horizontal drilling, geothermal drilling, mining, exploration, on and off-shore drilling, directional drilling, and any combination thereof. The bit body 201 is attached to the shank 200 and comprises an end which forms a working face 202. Several blades 101 extend outwardly from the bit body 201, each of which comprise a plurality of shear cutters 102. A drill bit 100 most suitable for the present invention may have at least three blades 101, preferably the drill bit 100 will have between three and seven blades 101. The blades 101 collectively form an inverted conical region 103. Each blade 101 may have a cone portion 253, a nose 204, a flank portion 205, and a gauge portion 207. Shear cutters 102 may be arrayed along any portion of the blades, including the cone portion 253, nose 204, flank portion 205, and gauge portion 207.

A jack element 104 is substantially coaxial with an axis 105 of rotation and extends within the conical region 103. The jack element 104 comprises a distal end 206 which falls within a range 320 (see FIG. 3) defined by a cutting surface 210 of at least one of the cutters 102. The cutter 102 may be attached to the cone portion 253 and/or the nose 204 of one of the blades 101. A plurality of nozzles 106 are fitted into recesses 107 formed in the working face 202. Each nozzle 106 may be oriented such that a jet of drilling mud ejected from the nozzles 106 engages the formation before or after the cutters 102. The jets of drilling mud may also be used to clean cuttings away from drill bit 100. In some embodiments, the jets may be used to create a sucking effect to remove drill bit cuttings adjacent the cutters 102 and/or the jack 104 by creating a low pressure region within their vicinities.

Figure 3:
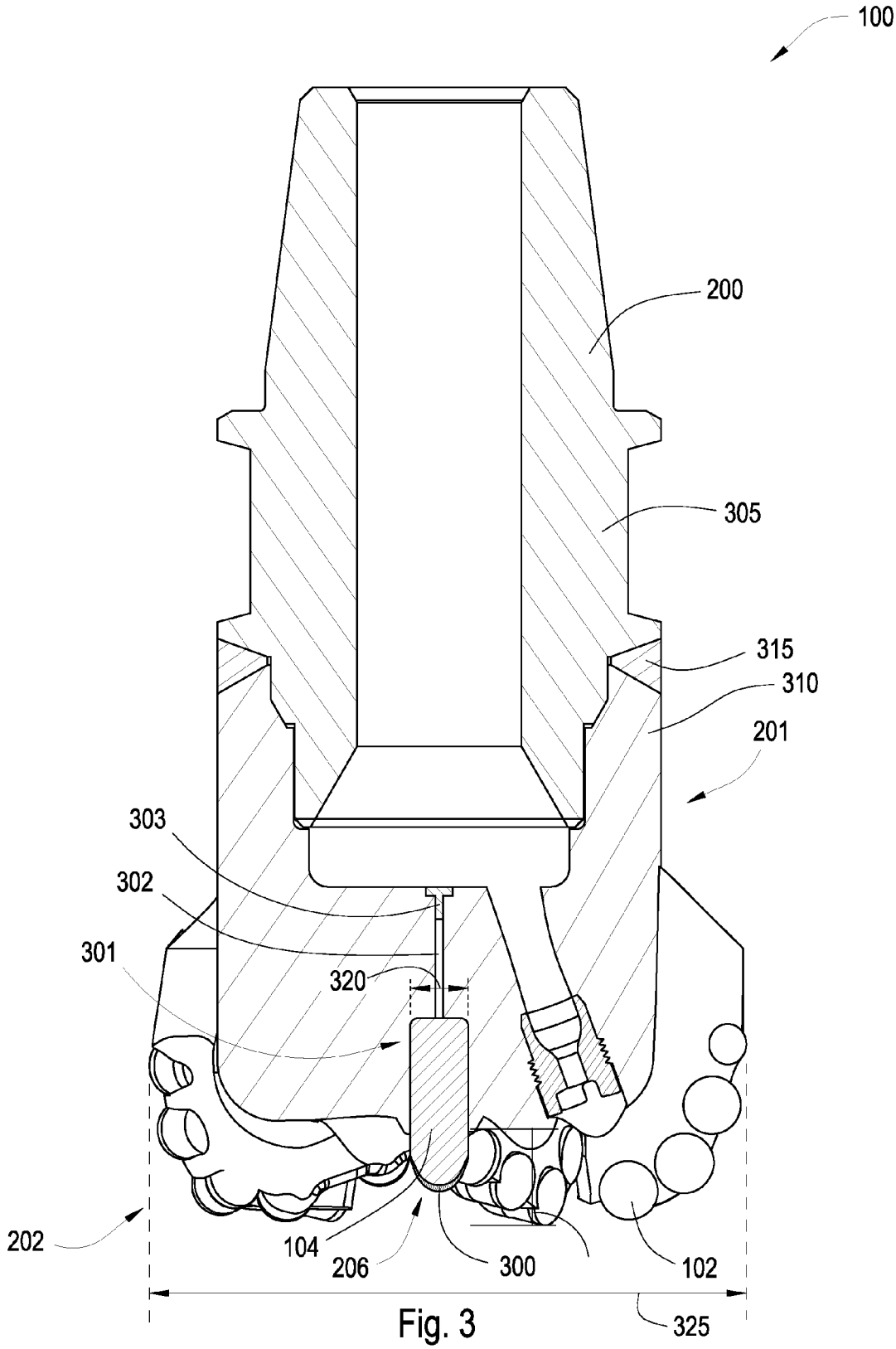
FIG. 3 is a cross sectional diagram of an embodiment of a drill bit.

FIG. 3 discloses a cross section of an embodiment of the drill bit 100. The jack element 104 comprises a hard surface 300 of a least 63 HRc. The hard surface 300 may be attached to the distal end 206 of the jack element 104, but it may also be attached to any portion of the jack element 104. In some embodiments, the jack element 104 is made of the material 300 of at least 63 HRc. In the preferred embodiment, the jack element 104 comprises tungsten carbide with polycrystalline diamond bonded to its distal end 206. Preferably, the shear cutters 102 also comprise a hard surface made of polycrystalline diamond. In some embodiments, the cutters 102 and/or distal end 206 of the jack element 104 comprise a diamond or cubic boron nitride surface. The diamond may be selected from group consisting of polycrystalline diamond, natural diamond, synthetic diamond, vapor deposited diamond, silicon bonded diamond, cobalt bonded diamond, thermally stable diamond, polycrystalline diamond with a cobalt concentration of 1 to 40 weight percent, infiltrated diamond, layered diamond, polished diamond, course diamond, fine diamond or combinations thereof. In some embodiments, the jack element 104 is made primarily from a cemented carbide with a binder concentration of 1 to 40 weight percent, preferably of cobalt. The working face 202 of the drill bit 100 may be made of a steel, a matrix, or a carbide as well. The cutters 102 or distal end 206 of the jack element 104 may also be made out of hardened steel or may comprise a coating of chromium, titanium, aluminum or combinations thereof.

The jack element 104 may be disposed within a pocket 301 formed in the bit body 201. The jack element 104 is brazed, press fit, welded, threaded, nailed, or otherwise fastened within the pocket 301. In some embodiments, the tolerances are tight enough that a channel 302 is desirable to allow air to escape upon insertion into the pocket 301 and allow air to fill in the pocket 301 upon removal of the jack element 104. A plug 303 may be used to isolate the internal pressure of the drill bit 100 from the pocket 301. In some embodiments, there is no pocket 301 and the jack element 104 is attached to a flat portion of the working face.

The drill bit 100 may be made in two portions. The first portion 305 may comprise at least the shank 200 and a part of the bit body 201. The second portion 310 may comprise the working face 202 and at least another part of the bit body 201. The two portions 305, 310 may be welded together or otherwise joined together at a joint 315.

The diameter of the jack element 104 may affect its ability to lift the drill bit 100 in hard formations. Preferably, the working face 202 comprises a cross sectional thickness 325 of 4 to 12 times a cross sectional thickness 320 of the jack element 104. Preferably, the working face 202 comprises a cross sectional area of 4 to 12 times the cross sectional area of the jack element 104.

Figure 4:
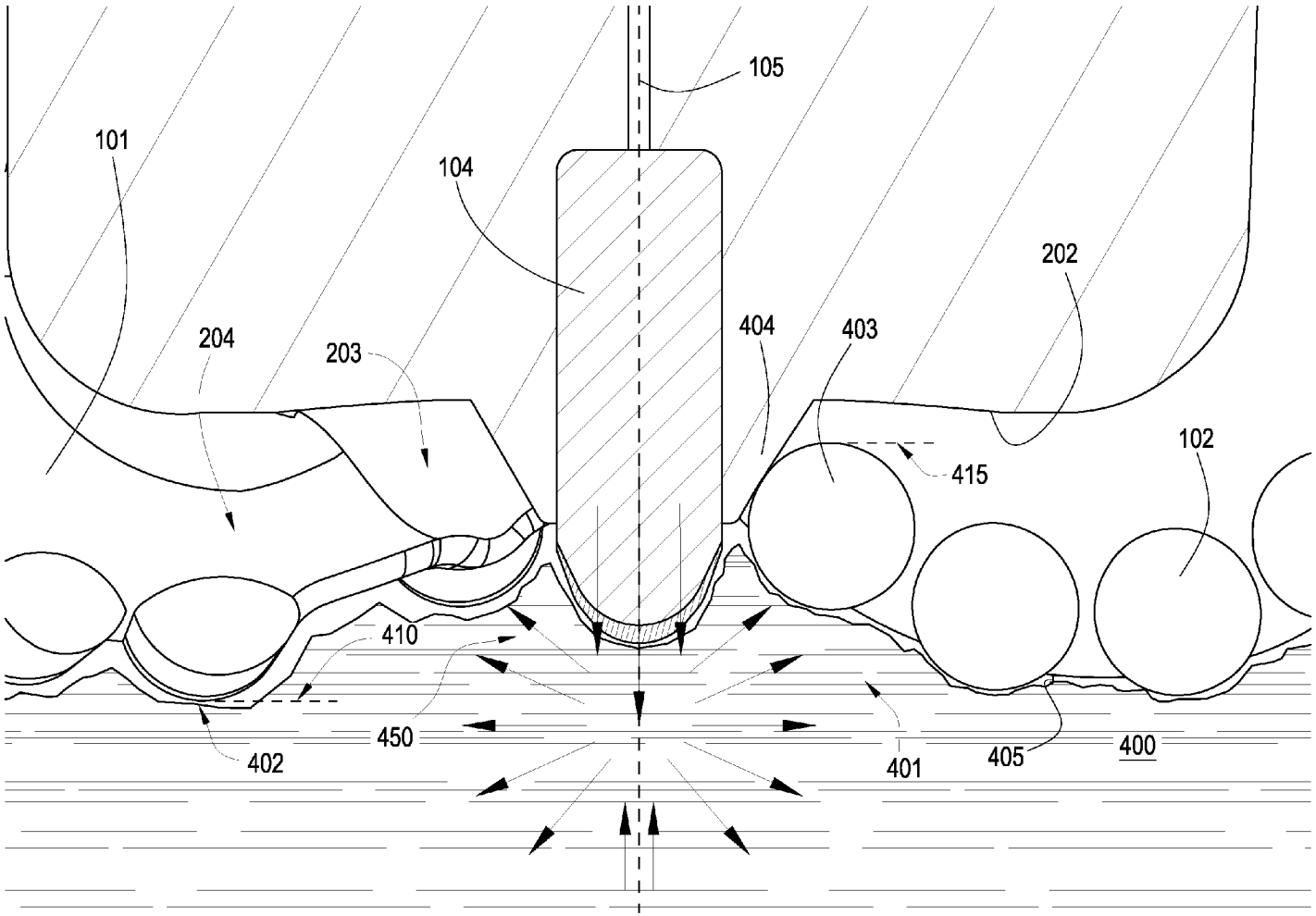
FIG. 4 is a cross sectional diagram of an embodiment of a jack element.

FIG. 4 discloses an embodiment of the jack element 104 engaging a formation 400. Preferably the formation is the bottom of a well bore. The effect of the jack element 104 may depend on the hardness of the formation 400 and also the weight loaded to the drill bit 100 which is typically referred to as weight-on-bit or WOB. An important feature of the present invention is the ability of the jack element 104 to share at least a portion of the WOB with the blades 101 and/or cutters 102. One feature that allows the jack element 104 to share at least a portion of the WOB is a blunt geometry 450 of its distal end.

One long standing problem in the industry is that cutters 102, such as diamond cutters, chip or wear in hard formations when the drill bit 100 is used too aggressively. To minimize cutter 102 damage, the drillers will reduce the rotational speed of the bit 100, but all too often, a hard formation is encountered before it is detected and before the driller has time to react. With the present invention, the jack element 104 may limit the depth of cut that the drill bit 100 may achieve per rotation in hard formations because the jack element 104 actually jacks the drill bit 100 thereby slowing its penetration in the unforeseen hard formations. If the formation 400 is soft, the formation may not be able to resist the WOB loaded to the jack element 104 and a minimal amount of jacking may take place. But in hard formations, the formation may be able to resist the jack element 104, thereby lifting the drill bit 100 as the cutters 102 remove a volume of the formation during each rotation. As the drill bit 100 rotates and more volume is removed by the cutters 102 and drilling mud, less WOB will be loaded to the cutters 102 and more WOB will be loaded to the jack element 104. Depending on the hardness of the formation 400, enough WOB will be focused immediately in front of the jack element 104 such that the hard formation will compressively fail, weakening the hardness of the formation and allowing the cutters 102 to remove an increased volume with a minimal amount of damage.

Typically, WOB is precisely controlled at the surface of the well bore to prevent over loading the drill bit 100. In experimental testing at the D.J. Basin in Colorado, crews have added about 5,000 more pounds of WOB than typical. The crews use a downhole mud motor in addition to a top-hole motor to turn the drill string. Since more WOB increases the depth-of-cut the WOB added will also increase the traction at the bit 100 which will increase the torque required to turn the bit 100. Too much torque can be harmful to the motors rotating the drill string. Surprisingly, the crews in Colorado discovered that the additional 5,000 pounds of WOB didn't significantly add much torque to their motors. This finding is consistent with the findings of a test conducted at the Catoosa Facility in Rogers County, Oklahoma, where the addition of 10,000 to 15,000 pounds of WOB didn't add the expected torque to their motors either. The minimal increase of torque on the motors is believed to be effected by the jack element 104. It is believed that as the WOB increases the jack element 104 jacks the bit 100 and then compressively fails the formation 400 in front of it by focusing the WOB to the small region in front of it and thereby weakens the rest of the formation 400 in the proximity of the working face 202. By jacking the bit 100, the depth of cut in limited, until the compressive failure of the formation 400 takes place, in which the formation 400 is weaker or softer and less torque is required to drill. It is believed that the shearing failure and the compressive failure of the formation 400 happen simultaneously.

As the cutters 102 along the inverted conical region 103 of the drill bit 100 remove portions of the formation 400 a conical profile 401 in the formation 400 may be formed. As the jack element 104 compressively fails the conical profile 401, the formation 400 may be pushed towards the cutters 102 of the conical portion 103 of the blades 101. Since cutting at the axis of rotation 105 is typically the least effective (where the cutter 102 velocity per rotation is the lowest) the present invention provides an effective structure and method for increasing the rate of penetration (ROP) at the axis of rotation. It is believed that it is easier to compressively fail and displace the conical profile 401 closer to its tip than at its base, since there is a smaller cross sectional area. If the jack element 104 extends too far, the cross sectional area of the conical profile 401 becomes larger, which may cause it to become too hard to effectively compressively fail and/or displace it. If the jack 104 extends beyond the leading most point 410 of the leading most cutter 402, the cross sectional area may become indefinitely large and extremely hard to displace. In some embodiments, the jack element 104 extends within 0.100 to 3 inches. In some embodiments, the jack element 104 extends within the cutting surface of cutter 403.

As drilling advances, the jack element 104 is believed to stabilize the drill bit 100 as well. A long standing problem in the art is bit whirl, which is solved by the jack element 104 provided that the jack 104 extends beyond the cutting surface 210 of at least one of the cutters 1400 within the conical region 103. The leading most cutter 402 may be attached to the nose 204 of at least one of the blades, preferably the jack element 104 does not extend beyond the cutting surface of cutter 402. The trailing most cutter 403 within the conical region 103 may be the cutter 403 closest to the axis 105 of rotation. Preferably the distal end 106 of the jack element 104 extends beyond the trailing most point 415 of cutter 403. Surprisingly, if the jack element 104 does not extend beyond the trailing most point 415 of the trailing most cutter 403, it was found that the drill bit 100 was only as stable as the typical commercially available shear bits. During testing it was found in some situations that if the jack element 104 extended too far, it would be too weak to withstand radial forces produced from drilling or the jack element 104 would reduce the depth-of-cut per rotation greater than desired. In some embodiments, the jack element 104 extends within a region defined as the depth of cut 405 of at least one cutter, which may be the trailing most cutter 403.

One indication that stability is achieved by the jack element 104 is the reduction of wear on the gauge cutters 1401. In the test conducted at the Catoosa Facility in Rogers County, Oklahoma the present invention was used to drill a well of 780 ft in 6.24 hours through several formations including mostly sandstone and limestone. During this test it was found that there was little to no wear on any of the polycrystalline diamond cutters 1401 fixed to the gauge of the drill bit 100—which was not expected, especially since the gauge cutters 1401 were not leached and the gauge cutters 1401 had an aggressive diameter size of 13 mm, while the cutters 1400 in the conical region 103 had 19 mm cutters. It is believed that this reduced wear indicates that there was significantly reduced bit whirl and that the drill bit 100 of the present invention drilled a substantially straight hole. The tests conducted in Colorado also found that the gauge cutters 1401 no little or no wear.

Figure 5:
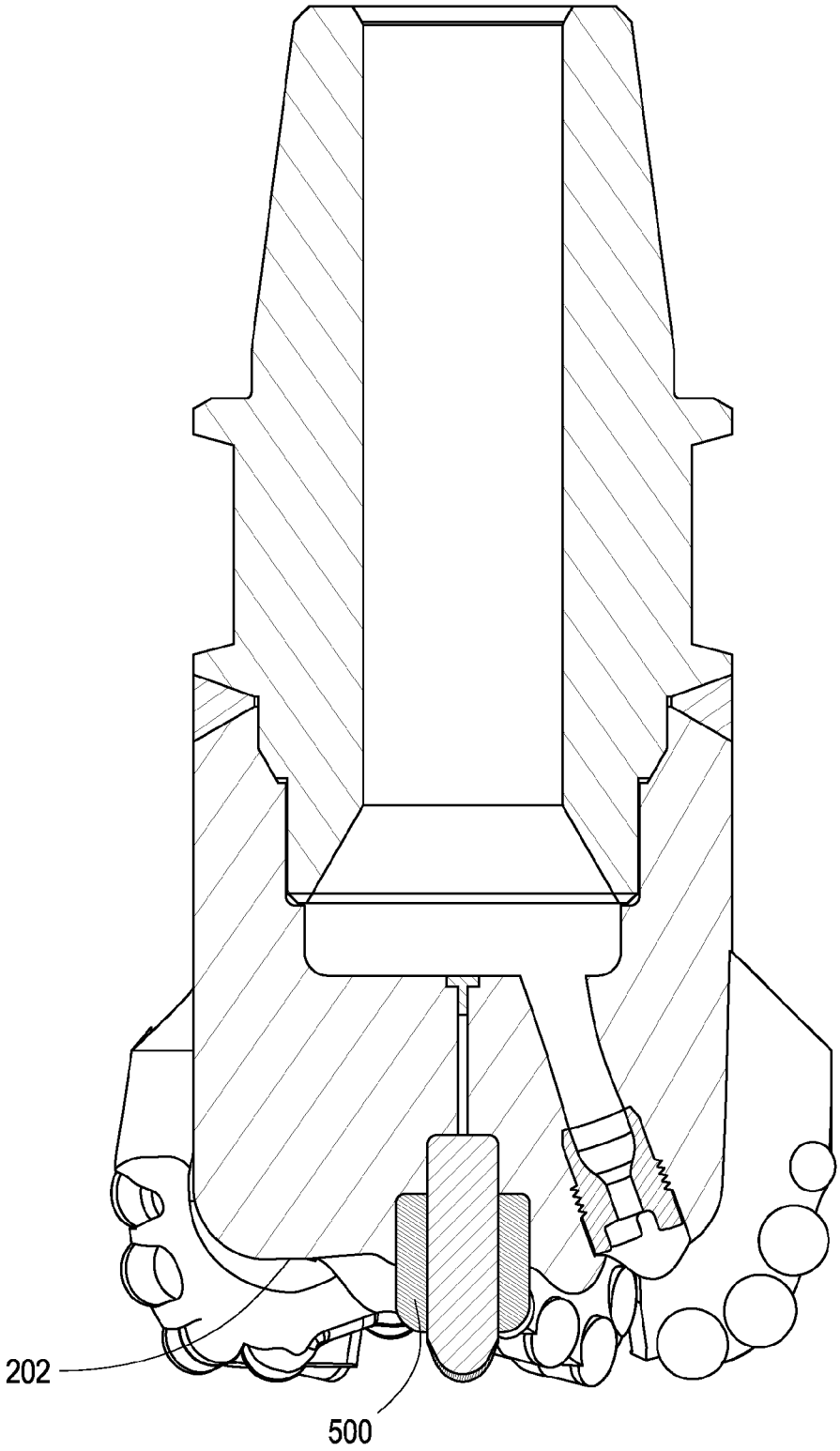
FIG. 5 is a cross sectional diagram of another embodiment of a drill bit.

Also shown in FIG. 4 is an extension 404 of the working face 202 of the drill bit 100 that forms a support around a portion of the jack element 104. Because the nature of drilling produces lateral loads, the jack element 104 must be robust enough to withstand them. The support from the extension 404 may provide the additional strength needed to withstand the lateral loads. In other embodiments a ring 500 may be welded or otherwise bonded to the working face 202 to give the extra support as shown in FIG. 5. The ring 500 may be made of tungsten carbide or another material with sufficient strength. In some embodiments, the ring 500 is made a material with a hardness of at least 58 HRc.

Figure 6:
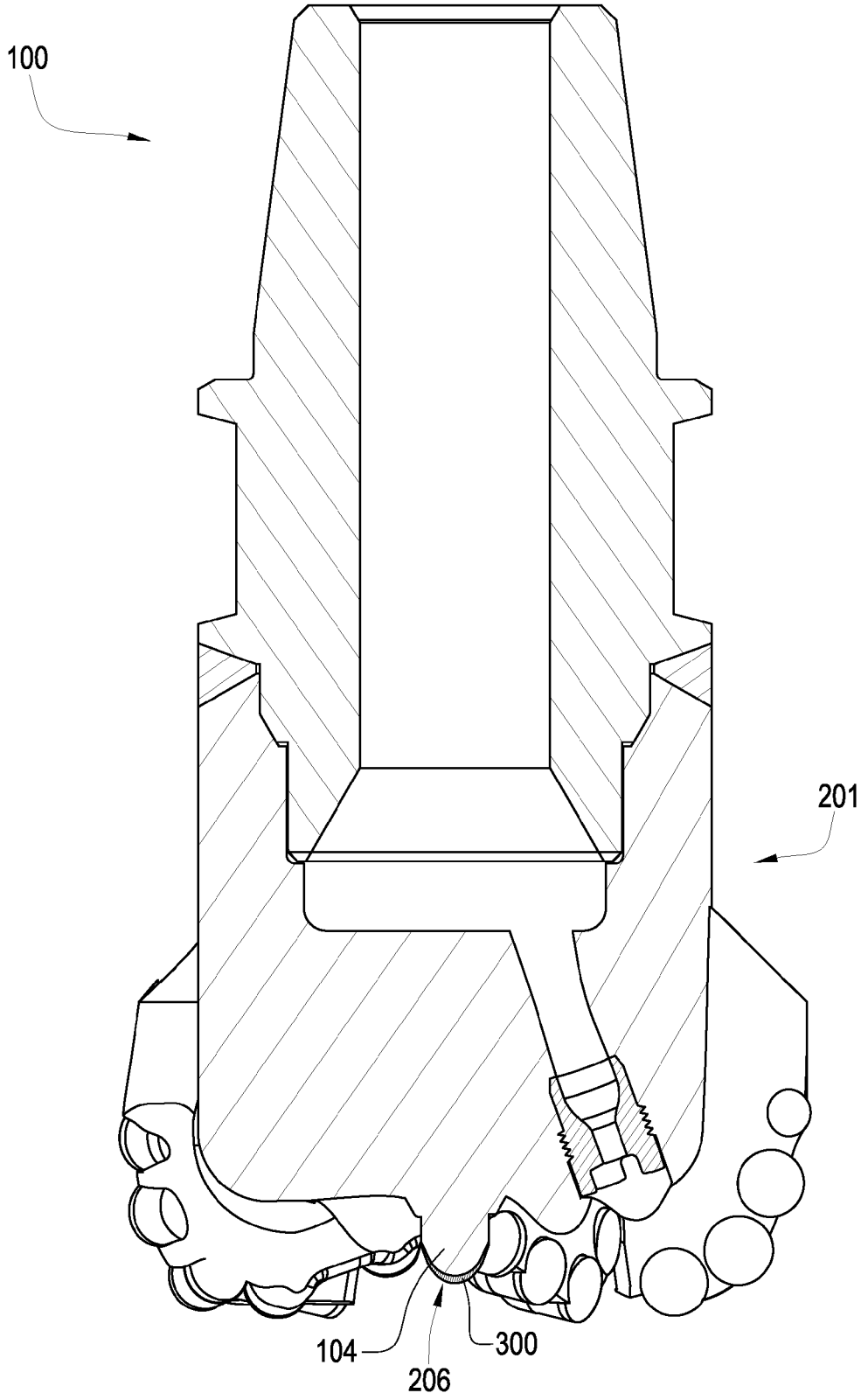
FIG. 6 is a cross sectional diagram of another embodiment of a drill bit.

FIG. 6 discloses a jack element 104 formed out of the same material as bit body 201. The distal end 206 of the jack element 104 may be coated with a hard material 300 to reduce wear. Preferably the jack element 104 formed out of the same material 300 comprises a blunt distal end. The bit body 201 and the jack element 104 may be made of steel, hardened steel, matrix, tungsten carbide, other ceramics, or combinations thereof. The jack element 104 may be formed out of the bit body 201 through electric discharge machining (EDM) or be formed on a lathe.

Figure 7:
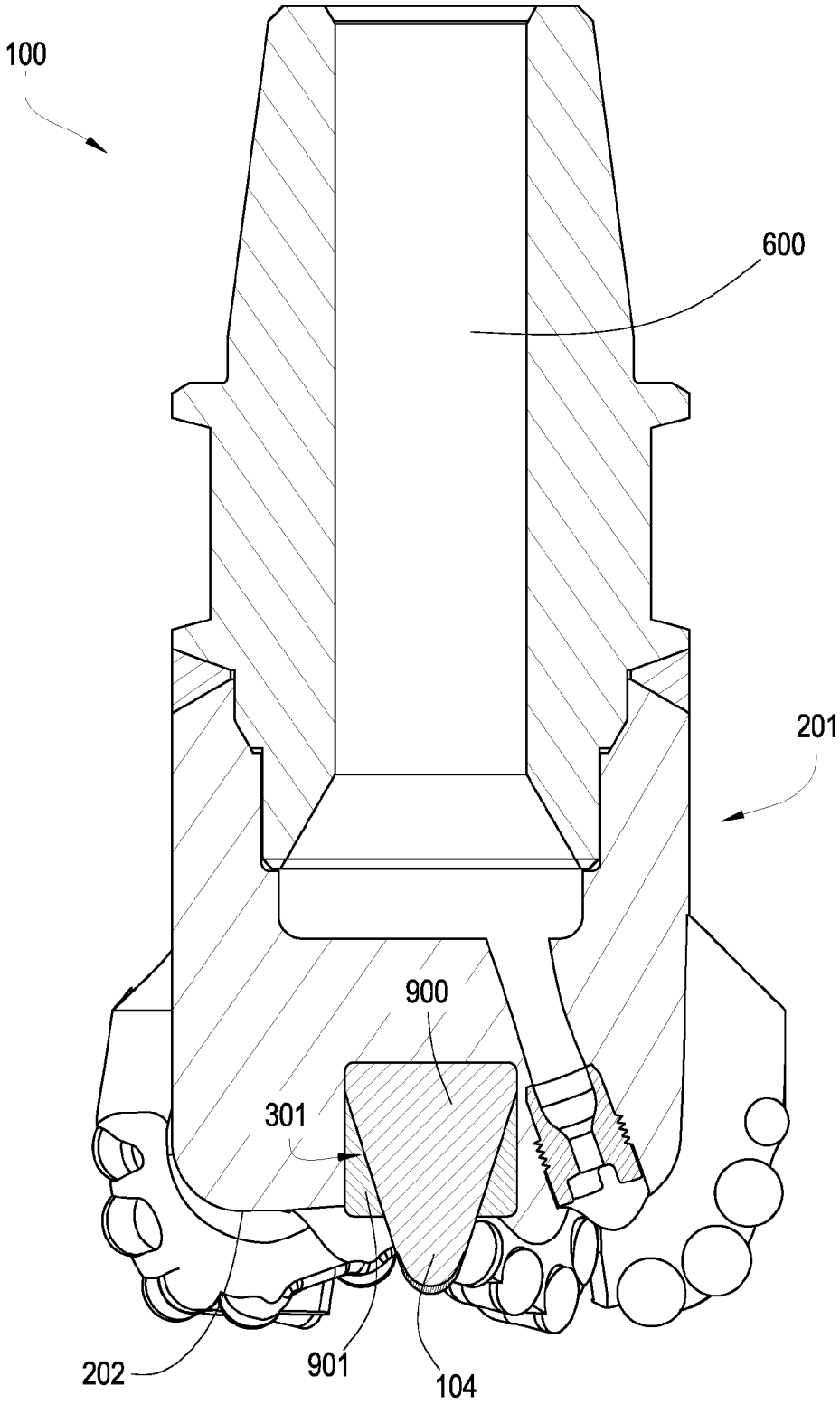
FIG. 7 is a cross sectional diagram of another embodiment of a drill bit.
Figure 10:
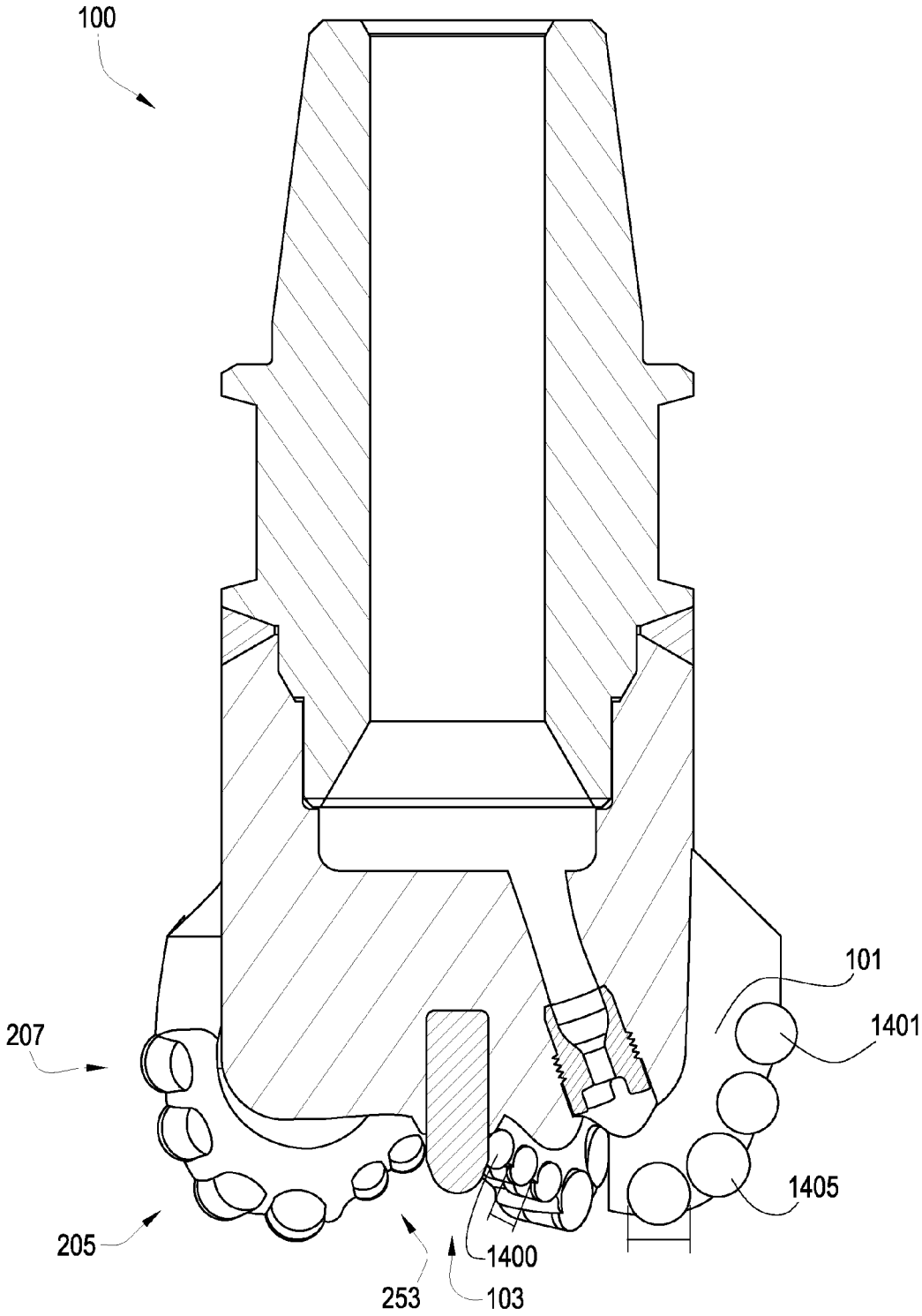
FIG. 10 is a cross sectional diagram of another embodiment of a drill bit.

FIG. 7 discloses a tapered jack element 104. In the embodiment of FIG. 7 the entire jack element 104 is tapered, although in some embodiments only a portion or portions of the jack element 104 may be tapered. A tapered jack element 104 may provide additional support to the jack element 104 by preventing buckling or help resist lateral forces exerted on the jack element 104. In such embodiments, the jack element 104 may be inserted from either the working face 202 or the bore 600 of the drill bit 100. In either situation, a pocket 301 is formed in the bit body 201 and the tapered jack element 104 is inserted. Additional material is then added into the exposed portion of the pocket 301 after the tapered jack element 104 is added. The material may comprise the geometry of the exposed portion of the pocket 301, such as a cylinder, a ring, or a tapered ring. In the embodiment of FIG. 10, the tapered jack element 104 is insertable from the working face 202 and a proximal end 900 of the jack element 104 is brazed to the closed end of the pocket 301. A tapered ring 901 is then bonded into the remaining portion of the pocket 301. The tapered ring 901 may be welded, friction welded, brazed, glued, bolted, nailed, or otherwise fastened to the bit body 201.

Figure 8:
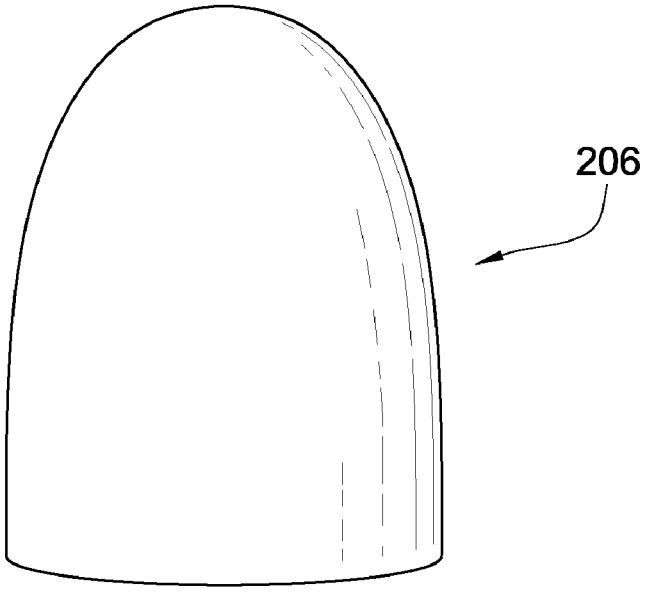
FIG. 8 is a perspective diagram of an embodiment of a distal end of a drill bit.
Figure 9:
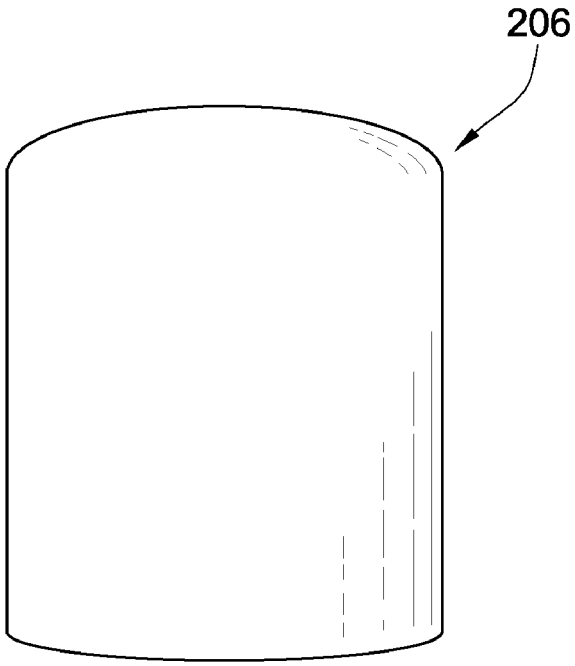
FIG. 9 is a perspective diagram of an embodiment of a distal end of a drill bit.

FIGS. 8-9 disclose embodiments of the distal end 206. The blunt geometry may comprise a generally hemispherical shape, a generally flat shape, a generally conical shape, a generally round shape, a generally asymmetric shape, or combinations thereof. The blunt geometry may be defined by the region of the distal end 206 that engages the formation. In some embodiments, the blunt geometry comprises a surface area greater than an area of a cutting surface of one of the cutters 102 attached to one of the blades 101. The cutting surface of the cutter 102 may be defined as a flat surface of the cutter 102, the area that resists WOB, or in embodiments that use a diamond surface, the diamond surface may define the cutting surface. In some embodiments, the surface area of the blunt geometry is greater than twice the cutter surface of one of the cutters 102.

FIG. 10 discloses a drill bit 100 of the present invention with cutters 1400 aligned on the cone portion 253 of the blades 101 which are smaller than the cutters 1401 on the flank or gauge portions 205, 207 of the bit 100. In the testing performed in both Colorado and Oklahoma locations, the cutters 1400 in the inverted conical region 103 received more wear than the flank or gauge cutters 1405, 1401, which is unusual since the cutter velocity per rotation is less than the velocity of the cutters 1401 placed more peripheral to these inner cutters 1400. Since the inner cutters 1400 are now subjected to a more aggressive environment, the cutters 1400 may be reduced in size to make the cutters 1400 less aggressive. The cutters 1400 may also be chamfered around their edges to make them less aggressive. The cutters 102 on the drill bit 100 may be 5 to 50 mm. 13 and 19 mm are more common in the deep oil and gas drilling. In other embodiments, such as the embodiment of FIG. 14, the inner cutters 1400 may be positioned at a greater negative rake angle 1500 than the flank or gauge cutters 1405, 1401 to make them less aggressive. Any of the cutters 102 of the present invention may comprises a negative rake angle 1500 of 1 to 40 degrees. In some embodiments of the present invention, only the inner most cutter on each blade has a reduced diameter than the other cutters or only the inner most diameter on each blade may be set at a more negative rake than the other cutters.

Figure 11:
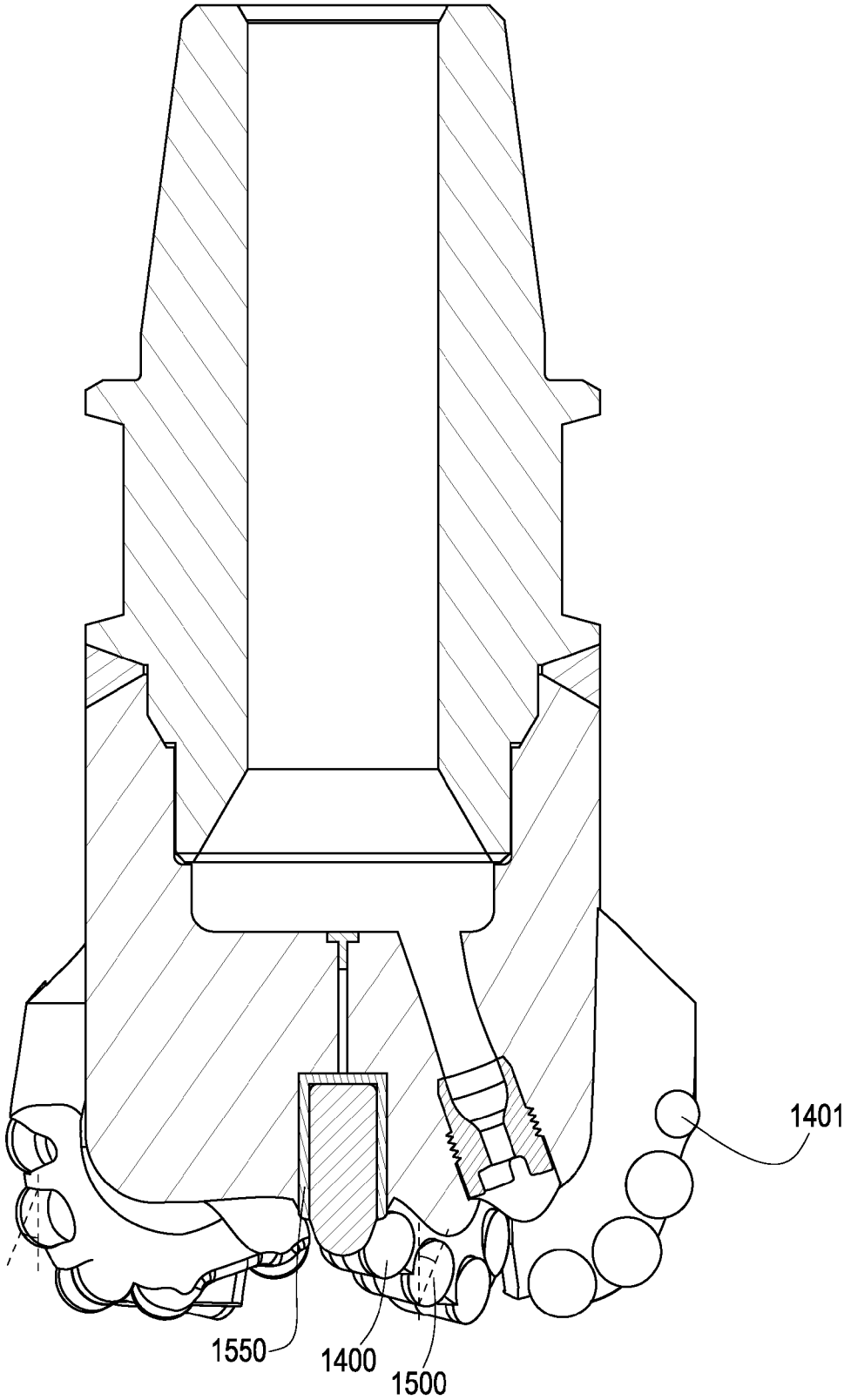
FIG. 11 is a cross sectional diagram of another embodiment of a drill bit.

FIG. 11 also discloses a sleeve 1550 which may be brazed into a pocket formed in the working face. The jack element may then be press fit into the sleeve. Instead of brazing the jack element directly into working face, in some embodiment it may be advantageous to braze in the sleeve. When the braze material cools the sleeve may misalign from the axis of rotation. The inner diameter of the sleeve may be machined after it has cooled so the inner diameter is coaxial with the axis of rotation. Then the jack element may be press fit into the inner diameter of the sleeve and be coaxial with the axis of rotation.

Figure 12:
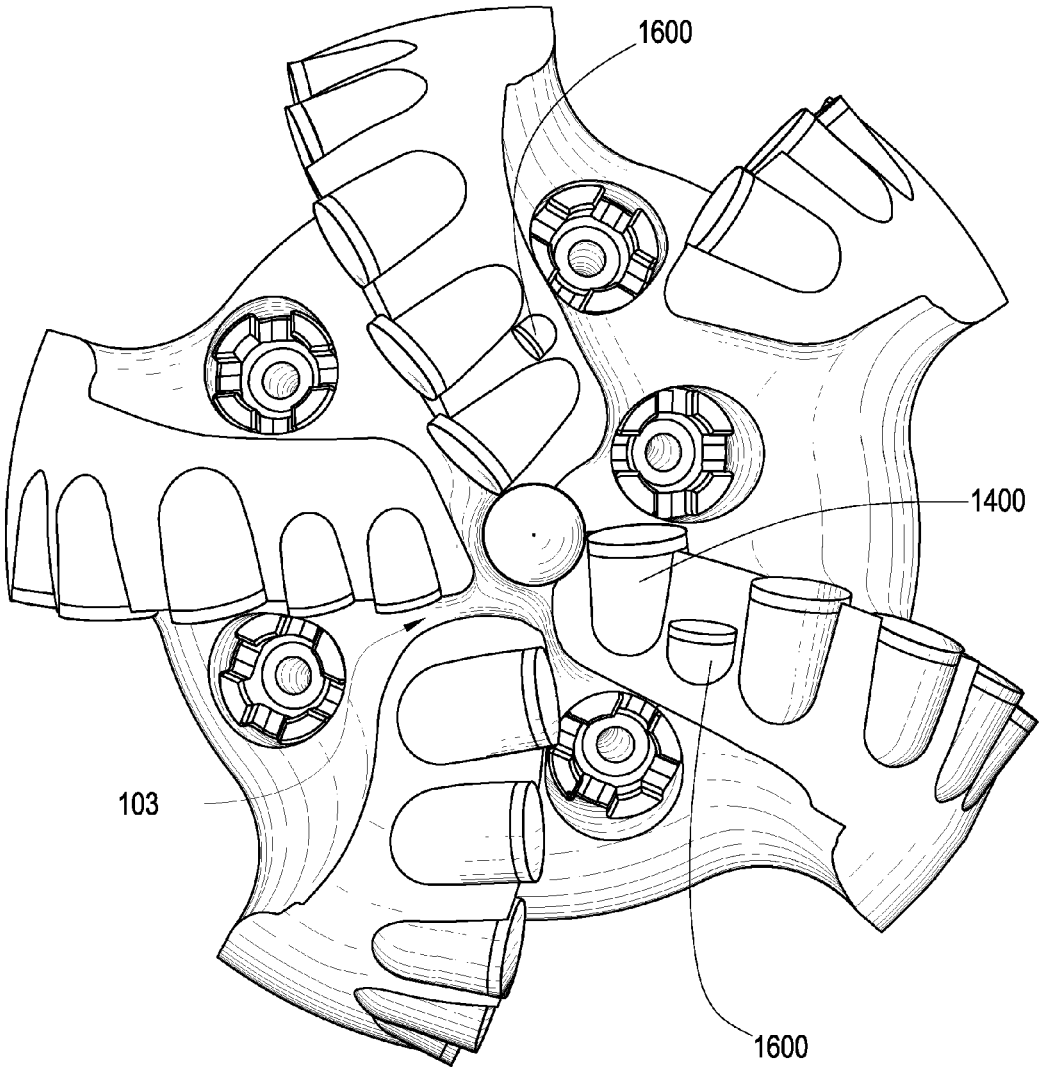
FIG. 12 is a bottom perspective diagram of another embodiment of a drill bit.

FIG. 12 discloses another embodiment of the present invention where more cutters 1400 in the conical region 103 have been added. This may reduce the volume that each cutter 1400 in the conical region 103 removes per rotation which may reduce the forces felt by the inner cutters 1400. Back-up cutters 1600 may be positioned between the inner cutters 1400 to prevent blade washout.

Figure 13:
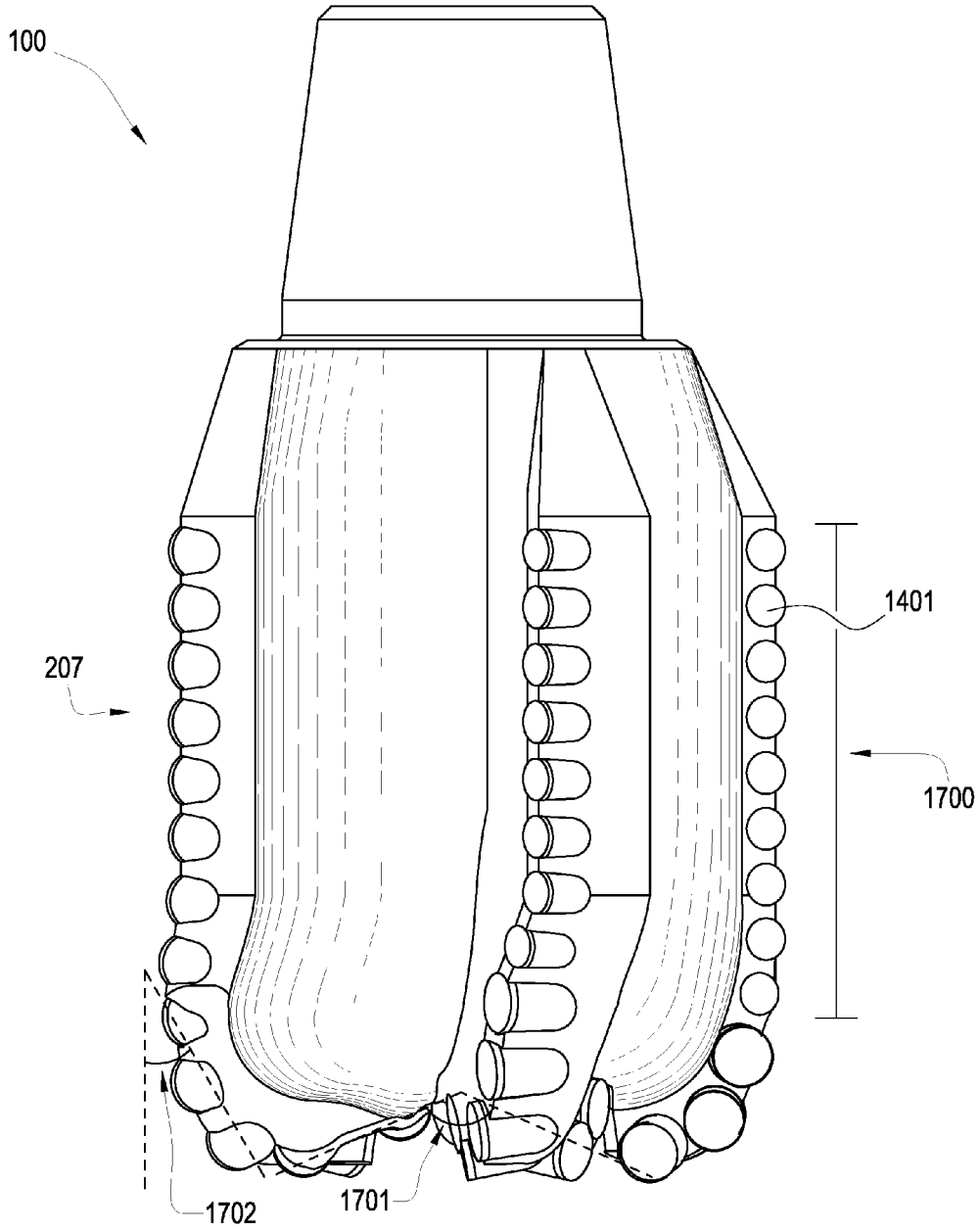
FIG. 13 is a perspective diagram of another embodiment of a drill bit.

FIG. 13 discloses an embodiment of the present invention with a long gauge length 1700. A long gauge length 1700 is believed to help stabilize the drill bit 100. A long gauge length 1700 in combination with a jack element 104 may help with the stabilizing the bit 100. The gauge length 1700 may be 0.25 to 15 inches long. In some embodiments, the gauge portion

207 may comprise 3 to 21 cutters 102. The cutters 102 of the present invention may have several geometries to help make them more or less aggressive depending on their position on the drill bit 100. Some of these geometries may include a generally flat shape, a generally beveled shape, a generally rounded shape, a generally scooped shape, a generally chisel shape or combinations thereof. In some embodiments, the gauge cutters 1401 may comprise a small diameter than the cutters 1400 attached within the inverted conical region 103.

FIG. 13 also discloses the cone angle 1701 and flank angle 1702 of the drill bit 100. These angles 1701, 1702 may be adjusted for different formations and different applications. Preferably, the cone angle 1701 may be anywhere from 25 to 155 degrees and the flank angle 1702 may be anywhere from 5 to 85 degrees.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:

an axis of rotation and a working face comprising a plurality of blades extending outwardly from a bit body;

the blades forming in part an inverted conical region;

a plurality of cutters comprising a cutting surface arrayed along the blades; and a jack element coaxial with the axis of rotation and extending within the conical region within a range defined by the cutting surface of at least one cutter;

the jack element being made of a carbide and being brazed or compression fitted into a pocket formed in the working face;

wherein the jack element is press fit into a sleeve which is brazed into the working face.

2. The bit of claim 1, wherein the cutter comprises a diamond surface selected from the group consisting of polycrystalline diamond, natural diamond, synthetic diamond, vapor deposited diamond, silicon bonded diamond, cobalt bonded diamond, thermally stable diamond, polycrystalline diamond with a cobalt concentration of 1 to 40 weight percent, infiltrated diamond, layered diamond, polished diamond, course diamond, fine diamond or combinations thereof.

3. The bit of claim 1, wherein the jack element comprises a distal end with a surface comprising a material with a hardness of at least 63 HRc.

4. The bit of claim 3, wherein the material comprises a polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond cubic boron nitride, chromium, titanium, matrix, diamond impregnated matrix, diamond impregnated carbide, a cemented metal carbide, tungsten carbide, niobium, or combinations thereof.

5. The bit of claim 1, wherein a distal end of the jack element comprises a blunt geometry.

6. The bit of claim 5, wherein the blunt geometry comprises a generally hemi-spherical shape, a generally flat shape, a generally conical shape, a generally round shape, a generally asymmetric shape, or combinations thereof.

7. The bit of claim 5, wherein the blunt geometry comprises a surface area greater than an area of the cutting surface.

8. The bit of claim 5, wherein the blunt geometry comprises a surface area at least twice as great as an area of the cutting surface.

9. The bit of claim 1, wherein at least one of the plurality of cutters disposed at a negative back rack angle of 1 to 40 degrees.

10. The bit of claim 1, wherein the bit comprises 3 to 7 blades.

11. The bit of claim 1, wherein the working face comprises a cross sectional thickness 6 to 12 times a primary diameter of the jack element.

12. The bit of claim 1, wherein the working face comprises a cross sectional area 6 to 12 times the cross sectional area of the jack element.

13. The bit of claim 1, wherein the bit further comprise a cone angle of 25 to 155 degrees.

14. The bit of claim 1, wherein the bit further comprises a flank angle of 5 to 85 degrees.

15. The bit of claim 1, wherein at least one cutter comprises a cutting surface with a diameter of 5 to 50 mm.

16. The bit of claim 1, wherein a cutter attached to a gauge of the bit comprises a cutting surface with a smaller diameter than a cutter attached within the conical region.

17. The bit of claim 1, wherein a cutter attached to the conical region comprises a cutting surface with a smaller diameter than a cutter attached to a gauge of the bit.

18. The bit of claim 1, wherein a gauge of the bit is 0.25 to 15 inches long.

19. The bit of claim 1, wherein a gauge comprises 9 to 21 cutters.

20. The bit of claim 1, wherein the at least one of cutting surfaces comprises a generally flat shape, a generally beveled shape, a generally rounded shape, a generally scooped shape, a generally chisel shape or combinations thereof.

21. The bit of claim 1, wherein the jack element extends 0.100 to 3 inches.

22. The bit of claim 1, wherein at least one of the blades comprises a back-up cutter.

23. The bit of claim 1, wherein the jack element is tapered.

24. The bit of claim 1, wherein a channel connects the pocket to a bore of the drill bit and the jack element is press fit into the pocket.

25. The bit of claim 1, wherein the working face extends adjacent the jack element.

26. The bit of claim 1, wherein the range is defined by the cutting surface of a trailing most cutter.

27. The bit of claim 26, wherein the range is defined by the depth of cut of the trailing most cutter.

28. The bit of claim 1, wherein the jack element comprises the characteristic of reducing the torque required to rotate the drill bit while downhole and in operation.

29. The bit of claim 1, wherein the jack element comprises the characteristic of reducing wear on cutters attached to the gauge of the bit while downhole and in operation.

30. A drill bit, comprising:

an axis of rotation and a working face comprising a plurality of blades extending outwardly from a bit body;

the blades forming in part an inverted conical region;

a plurality of cutters comprising a cutting surface arrayed along the blades; and the jack element being made of a carbide and being brazed or compression fitted into a pocket formed in the working face;

wherein the jack element comprises the characteristic of reducing the torque required to rotate the drill bit while downhole and in operation;

wherein the jack element is press fit into a sleeve which is brazed into the working face.

* * * * *